US007665311B2

(12) United States Patent
Steffensen et al.

(10) Patent No.: US 7,665,311 B2
(45) Date of Patent: Feb. 23, 2010

(54) APPARATUS FOR HEATING AND COOLING AT FOOD SERVING STATIONS

(76) Inventors: Chris Steffensen, 1242 E. Sandra Cir., Salt Lake City, UT (US) 84121; Tyler Lyon, 2329 Saddleback View Cir., Bluffdale, UT (US) 84065; Daniel Winegar, 3064 Country Classic Dr., Bluffdale, UT (US) 84065; Jeffrey Turner, 6590 S. 2200 East, Salt Lake City, UT (US) 84121

( * ) Notice: Subject to any disclaimer, the term of this patent is extended or adjusted under 35 U.S.C. 154(b) by 81 days.

(21) Appl. No.: 11/823,628

(22) Filed: Jun. 28, 2007

(65) Prior Publication Data

US 2008/0016881 A1 Jan. 24, 2008

Related U.S. Application Data

(60) Provisional application No. 60/816,978, filed on Jun. 28, 2006.

(51) Int. Cl.
*F25B 21/02* (2006.01)

(52) U.S. Cl. ..... 62/3.3; 62/3.7

(58) Field of Classification Search ..... 62/3.2, 62/3.3, 3.7; 165/58

See application file for complete search history.

(56) References Cited

U.S. PATENT DOCUMENTS 3,214,922 A 11/1965 Koblischek
3,314,242 A 4/1967 Lefferts
5,154,661 A * 10/1992 Higgins ..... 62/3.3
5,653,111 A * 8/1997 Attey et al. ..... 62/3.7
5,711,155 A * 1/1998 DeVilbiss et al. ..... 62/3.7
5,718,124 A 2/1998 Senecal
5,782,094 A 7/1998 Freeman
5,941,077 A 8/1999 Safyan
6,409,186 B2 6/2002 Bennington
6,502,405 B1 * 1/2003 Van Winkle ..... 62/3.61
6,735,958 B2 5/2004 Baumann
2006/0277924 A1 12/2006 Platkin

* cited by examiner

*Primary Examiner*—Melvin Jones
(74) *Attorney, Agent, or Firm*—Morriss O'Bryant Compagni

(57) ABSTRACT

Systems and apparatus for heating or cooling food to an appropriate temperature for service using a standard food service container, such as a chafing dish or food cart. A thermally conductive plate has a plurality of Peltier chips attached thereto to drive a temperature difference. The Peltier chips are in thermally conductive contact with a heat exchanger. A heat transfer liquid circulates through tubing in the heat exchanger and a separate radiator, perpetuating the temperature difference at the plate. The heat exchanger and radiator may be spaced apart by a gap. One or more fans may be placed to encourage airflow through the radiator. A coolant reservoir and pump may be included.

18 Claims, 5 Drawing Sheets

APPARATUS FOR HEATING AND COOLING AT FOOD SERVING STATIONS

CROSS-REFERENCE TO RELATED APPLICATION

This application claims the benefit of U.S. Provisional Application No. 60/816,978, filed Jun. 28, 2006, which is incorporated herein by reference in its entirety.

TECHNICAL FIELD

The present invention relates generally to the service of food at a desired temperature and, more particularly, to systems and apparatus for heating and cooling food for serving.

BACKGROUND

Perishable foods for home, market, catering and restaurant buffets are conventionally chilled by ice or commercially manufactured containers of freezable material, or by refrigeration systems. When the ice melts and the freezable material warms, these cooling media lose their ability to keep foods safe and may render them unsuitable or hazardous for consumption. Refrigeration systems are bulky and costly, requiring condensers, coils and harmful chemicals and, further, must be serviced and maintained. Additionally, they are not easily adapted for portability.

Other foods need to be heated or kept warm for home, market, catering and restaurant buffet service. Conventional sources of heat include flame and electricity, e.g. by use of alcohol-based combustible gels, such as those offered under the tradename STERNO, or by electric hot plates. Flame sources often produce local hot spots and uneven heating and may produce fumes, odors, or other combustion products. The indoor pollution and health risks to food service workers and patrons from these combustion products are beginning to be viewed with concern by those in the industry.

An earlier design of a warm-up and cooling tray for ready-to-serve food is described in U.S. Pat. No. 5,941,077, the disclosure of which is incorporated herein by reference. Such design features two heat-conducting plates in an enclosure, two Peltier elements positioned underneath these plates, a control device for switching the Peltier elements into a plate-cooling or plate-heating mode, as well as selector switches for selecting the desired mode and temperature. U.S. Pat. No. 6,735,958, the disclosure of which is also incorporated by reference, explains that the type of heating and cooling tray disclosed in the '077 patent suffers from a shortcoming in that it cannot produce plate temperatures that lead to ready-to-serve food temperatures in line with current requirements for hygienic considerations. The '958 patent addresses this shortcoming by combining a foil-type heating element with the Peltier elements in order to heat the hot plates of the design "more quickly and/or to higher temperature levels than is possible with Peltier elements alone", thus achieving temperatures that meet current hygienic requirements. However, by requiring additional heating elements, additional components, monitoring elements, and control circuitry are required to manage the interaction of the disparate type of heating elements, thus raising the costs of such a design.

Consequently, a device that allows for both heating and cooling of a food with a simple set of controls and using only a single-type of temperature adjusting element would be an improvement in the art. The ability to use such a device with pre-existing food service trays, carts and chafing dishes would be an additional improvement. Such a device that is portable and battery powered would be a further improvement.

SUMMARY

The present invention provides an apparatus for heating or cooling food to an appropriate temperature for service in a standard food service container, such as a chafing dish or food cart. A thermally conductive plate has a plurality of Peltier chips attached thereto to drive a temperature difference. The Peltier chips are in thermally conductive contact with a heat exchanger. A heat transfer liquid, such as a food grade coolant or water circulates through tubing in the heat exchanger and a separate radiator, perpetuating the temperature difference at the plate. The heat exchanger and radiator may be spaced apart by a gap. One or more fans may be placed to encourage airflow through the radiator. A coolant reservoir and pump may be included. In some embodiments, the apparatus may be sized to fit within a standard chafing dish and may include a battery for portability.

DESCRIPTION OF THE DRAWINGS

It will be appreciated by those of ordinary skill in the art that the various drawings are for illustrative purposes only. The nature of the present invention, as well as other embodiments of the present invention, may be more clearly understood by reference to the following detailed description of the invention, to the appended claims, and to the several drawings.

DETAILED DESCRIPTION

The present invention relates to systems for heating or cooling food to an appropriate temperature for service in a standard food service container, such as a chafing dish or food cart. It will be appreciated by those skilled in the art that the embodiments herein described, while illustrating certain embodiments, are not intended to limit the invention or the scope of the appended claims. Those skilled in the art will also understand that various combinations or modifications of the embodiments presented herein can be made without departing from the scope of the invention. All such alternate embodiments are within the scope of the present invention. Similarly, while the drawings depict illustrative embodiments of the devices and components in accordance with the present invention and illustrate the principles upon which the device is based, they are only illustrative, and any modification of the invented features presented here are to be considered within the scope of this invention.

Figure 1A:
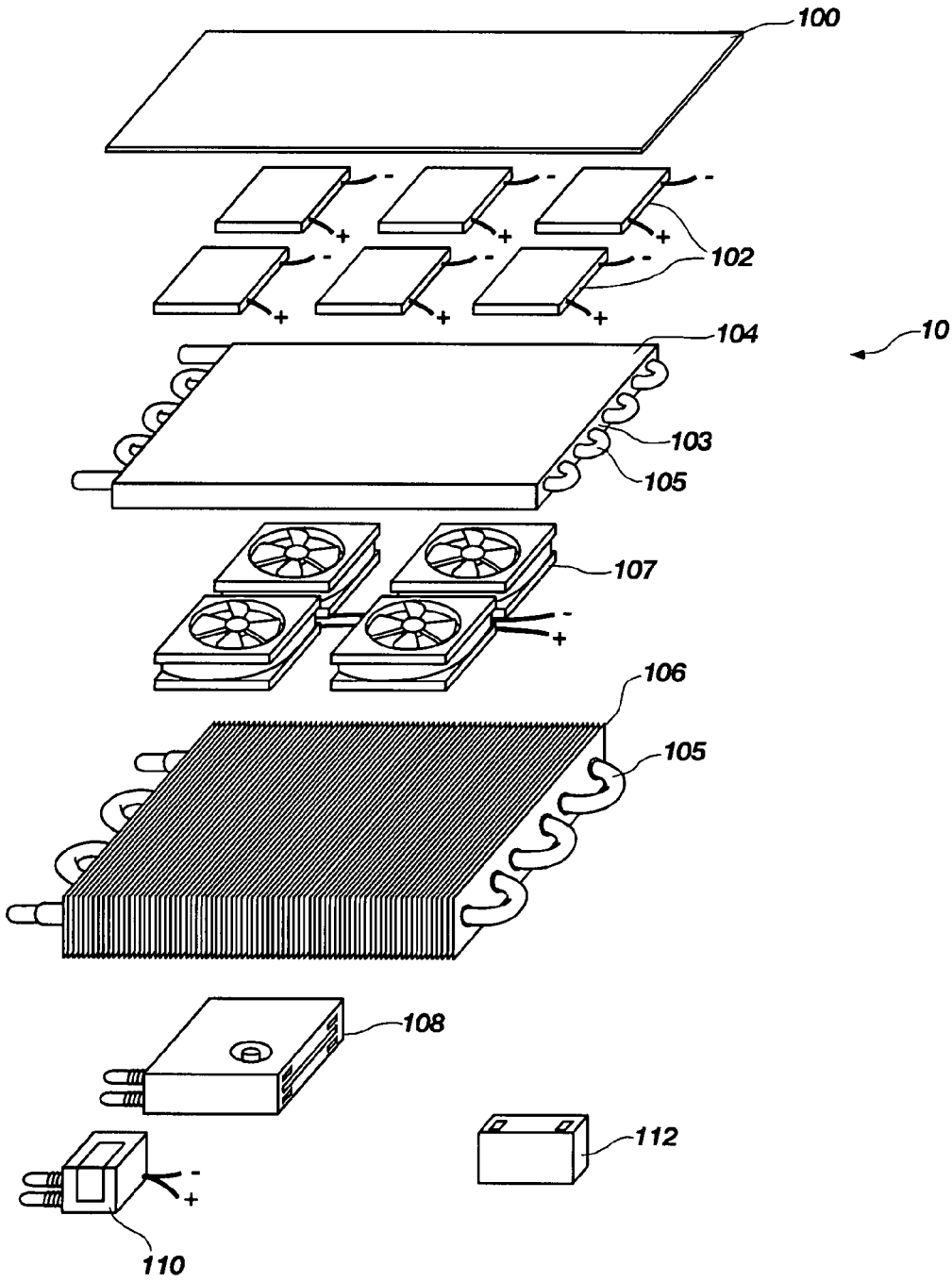
FIGS. 1A and 1B are exploded views of a number of components of two different unassembled systems in accordance with the principles of the present invention.
Figure 2:
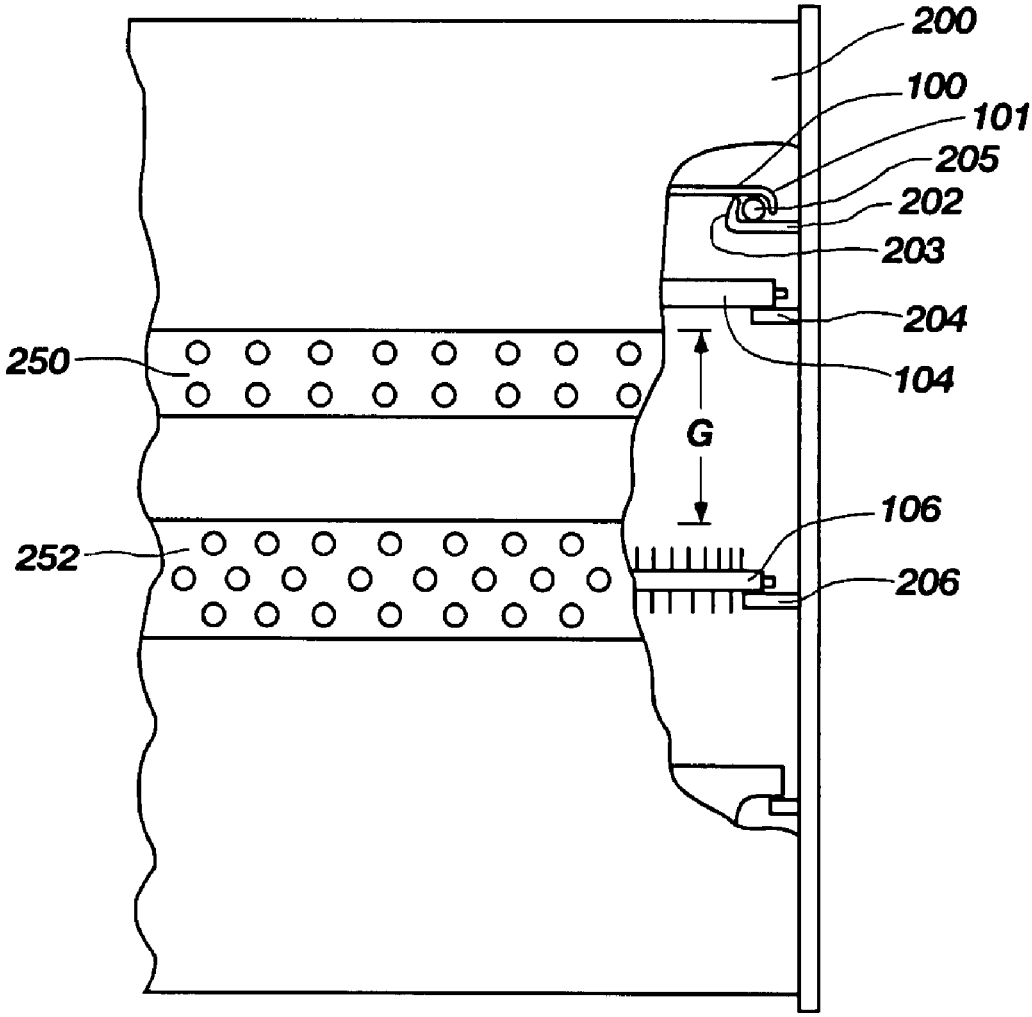
FIG. 2 is a cutaway partial side view showing the relationship of some of the components of FIG. 1A with a frame or pan.
Figure 3:
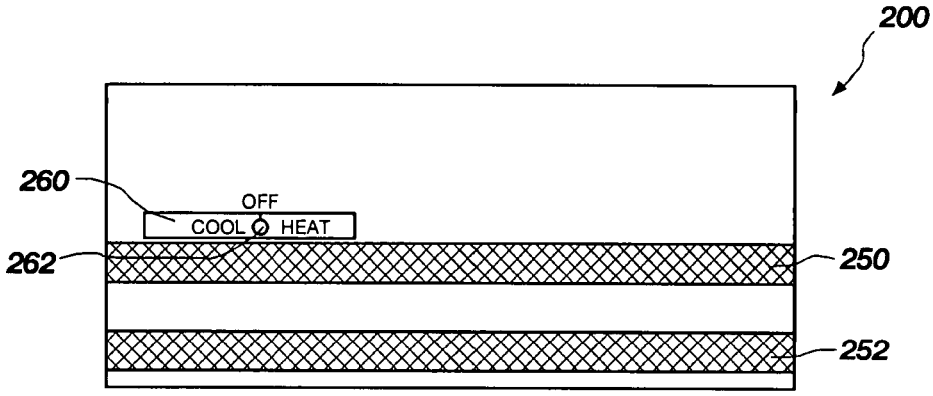
FIG. 3 is a side view of the pan of FIG. 2, showing a set of controls for an apparatus in accordance with the present invention.

FIG. 1A depicts one illustrative embodiment of components for an apparatus 10 in accordance with the present invention, shown in an exploded view. In some embodiments, these components will be retained in a frame 200 or "pan" as depicted in FIGS. 2 and 3. For clarity, this description will refer to FIGS. 1A, 2 and 3, and like elements are consistently numbered therebetween.

A thermally conductive plate 100 forms the upper portion of the apparatus 10. The thermally conductive plate 100 may be made from a thermally conductive material and must be strong enough to hold a steam tray, chafing dish, or other food container, such as a pan. Suitable thermally conductive materials may include copper, steel, aluminum or other metallic sheets, but it will be appreciated that any thermally conductive material of sufficient strength may be used.

Mounted underneath the thermally conductive plate 100 is a plurality of Peltier chips 102. Each Peltier chip 102 is a thermoelectric converter element whose effect is based on the Peltier principle in that they are capable of both cooling and heating by virtue of the fact that between their electrodes a temperature differential is created whose directionality is a function of the direction of the current. In the depicted embodiment, six Peltier chips 102 are shown. It will be appreciated that any number may be used, which is sufficient to heat or cool plate 100 to a suitable temperature. Applicants have found that a plurality of Peltier chips is capable of reaching suitable temperatures, contrary to the teachings of the cited prior art references.

Each Peltier chip 102 may be mounted to the plate 100. This may be accomplished with a thermally conductive epoxy. One suitable epoxy is the GREEN EPOXY available from Marlow Industries, Dallas, Tex. Alternatively, each Peltier chip 102 may be mounted to the plate 100 by using a mounting bracket, which contacts the Peltier chip 102 to the plate 100. Thermal grease may be disposed between the Peltier chip 102 and the plate 100 to facilitate thermal flow.

The underside of each Peltier chip 102 is mounted to a heat exchanger 104, as by bonding with thermal epoxy, or using a mounting bracket and thermal grease. Heat exchanger 104 includes a body 103 made of a thermally conductive material through which runs tubing 105. Tubing 105 allows circulation of a heat transfer liquid, such as a coolant, through the heat exchanger 104. For example, where the Peltier chips 102 are running in a cooling mode, and the "hot" side of the chips 102 faces the heat exchanger 104, circulation of coolant through the tubing may be used to remove waste heat from the chips 102.

Tubing 105 exits the heat exchanger 104 and is continuous to a radiator 106 positioned below the heat exchanger 104. The tubing 105 may also be communicatively connected with a reservoir 108 and a pump 110. Reservoir 108 provides an opening and cap for filling and draining heat exchange fluid, and pump 110 may be used to circulate the heat transfer fluid through the tubing 105. In some embodiments, pump 110 and reservoir 108 may be positioned beneath the radiator 106, in order to facilitate access thereto. Pump 110 may be any pump with sufficient power to circulate heat transfer fluid through the tubing 105 at a rate sufficient to allow the device to function at an acceptable rate of heating or cooling. Typically, centrifugal-type pumps may be used, although it may be possible to utilize a larger in-line pump.

The radiator 106 is typically finned to provide a larger surface area for convection heat exchange to the surrounding air. The heat transfer fluid may be circulated through the tubing from the heat exchanger 104 to the radiator 106. Since the apparatus 10 is used for heating or cooling food, a non-toxic heat transfer fluid may be used. One such fluid is water, although other acceptable commercially available non-toxic coolants, such as PAHNOL, offered by Houton Chemical, may be used.

As depicted, the generally planar radiator 106 is positioned such that the generally planar body is in a horizontal position which is spaced apart from the heat exchanger 104 by a gap G (best depicted in FIG. 2), to allow for airflow therebetween. The gap must be sufficient to allow airflow therethough in order to have an acceptable level of cooling. One or more fans 107 may be attached to the radiator 106 within the gap G to facilitate air movement through the gap G and across radiator 106 to enhance heat exchange. Fans 107 may be directly attached to the radiator 106 with a suitable thermal epoxy, by attachment using a mounting bracket, or in any other suitable manner. For example, the fans 107 may be attached to a grillwork, which is then strapped to the radiator 106.

In some alternative embodiments, rather than bond each Peltier chip 102 to a common heat exchanger 104, each individual Peltier chip 102 may be bonded to a separate cooling block, which has a channel for circulation of a heat transfer fluid therethrough. Common tubing may connect the channels to the radiator 106, as described above with respect to heat exchanger 104. A single heat exchanger 104 is currently preferred, due to the reduction in parts necessary for assembly of an apparatus 10.

Electric power for the apparatus 10 may be provided by a battery 112, which may also be contained within the frame 200. Such a battery powered device is extremely portable and may be used in locations where connection to an electrical outlet is undesirable or impossible. Of course, it will be appreciated that a transformer and line connection may be used to provide connection to any standard electrical outlet for power. Currently, it is preferred to operate the components of the apparatus 10 at a voltage of up to about 15V.

Turning to FIG. 2, a cutaway view is depicted, showing one embodiment of the interactions of the components of FIG. 1 with a frame or pan 200 to complete an apparatus 10. As depicted in FIGS. 2 and 3, frame 200 may be a metallic box with an open top and bottom, sized for use as a chafing dish or in a mobile food cart. It will be appreciated that, although depicted as having a rectangular shape, the frame 200 and components may have any desired shape for a particular application, such as a round or triangular frame and components for specific chafing dishes or food carts.

Frame 200 includes a number of vertically dispersed ridges, protuberances or shelves for interaction with components of the apparatus 10. The uppermost such shelf 202 encircles the entire internal perimeter of frame 200 and may have a raised lip 203 at the distal end. A gasket 205 may be placed in the shelf 202 and thermally conductive plate 100 rests thereon. As depicted, thermally conductive plate 100 may have a down turned lower edge 101. Gasket 205 may be compressed between plate 100 and shelf 202 to form a seal therebetween. This allows for upper portion of the frame 200, floored by plate 100, to act as a single chamber with a floor and sidewalls. For example, food spilled from a dish placed therein will be maintained therein. This protects the remaining components and facilitates clean up. The area above the plate 100 thus may also be used as a steam tray by filling with water, or as a pan that directly contacts the food product.

Two lower sets of protuberances 204 and 206 provide support for the heat exchanger 104 and radiator 106, respectively. Each of the lower sets of protuberances may be comprised of a number (such as two or four) brackets extending at opposite sides of the frame 200, or may be shelves formed from the metal of frame 200, which may extend for a short distance upon any side of the frame 200, or may encircle the frame 200. As shown, the radiator 106 and heat exchanger 104 may simply rest upon protuberances or may be attached thereto, as appropriate. Additional structures may be placed in the frame for retaining the battery 112, pump 110 and reservoir 108, as desired for the particular embodiment.

FIG. 3 depicts a side view of frame 200, which shows a vented band 250 around frame 200 formed at the level of gap G (FIG. 2). This vented band may be formed by placing a number of slots or openings in the frame 200 or as otherwise known to those of skill in the art (as by screening one or more large openings in the frame 200). A second lower vented band 252 may be formed at the level of the radiator 106. The vented bands facilitate airflow across the radiator 106.

Figure 5:
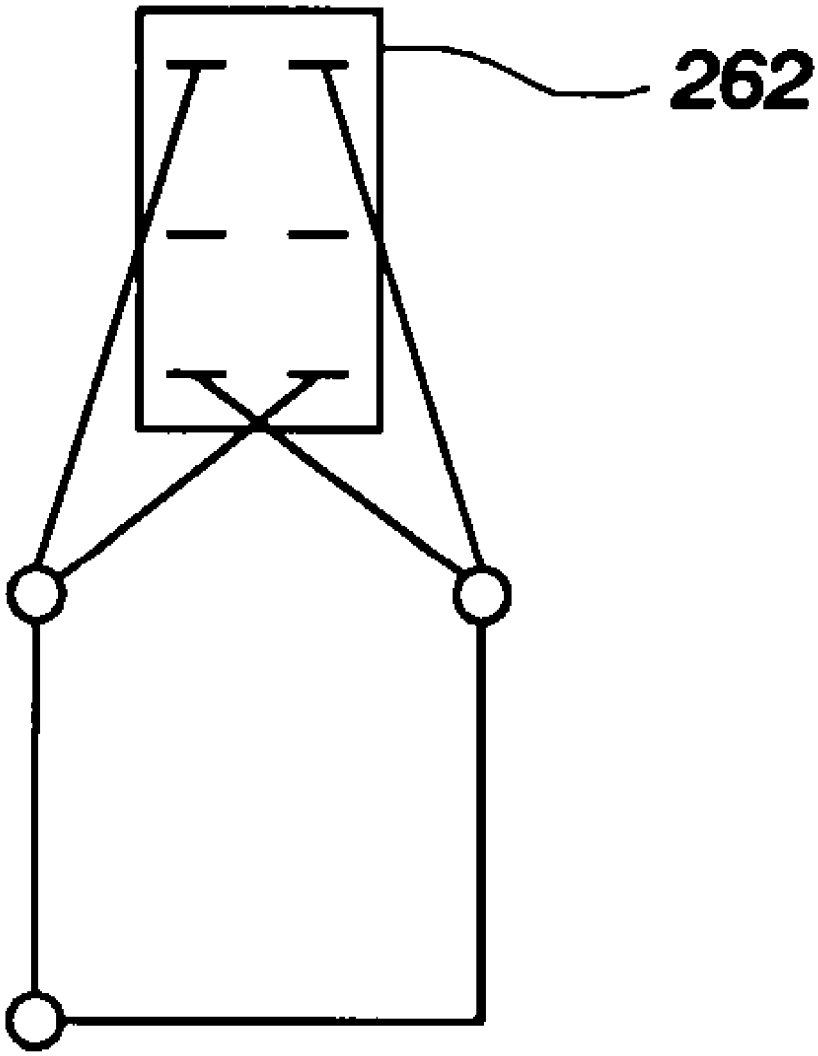
FIG. 5 is a wiring diagram, showing embodiments of wiring the Peltier elements of the systems of FIGS. 1A and 1B.

Also depicted in FIG. 3 is a control panel 260 for the apparatus 10. Control panel 260 may simply consist of a single switch 262 with three settings, OFF, COOL and HEAT. Switch 262 may consist of a double-pull double-throw switch. Selection of either closed position, (HEAT or COOL) closes the circuit in an opposite direction, reversing the flow of electricity through the Peltier chips 102 and either cooling or heating thermally conductive plate 100, as depicted in FIG. 5. In the COOL position, the pump 110 and fans 107 may also be activated to transfer waste heat away from the plate 100.

In testing, an embodiment similar to that depicted in FIG. 1A has been shown to maintain plate 100 at a temperature of up to 290 degrees F. in a heating mode and to maintain the plate at or below 46 degrees F. in a cooling mode.

Figure 1B:
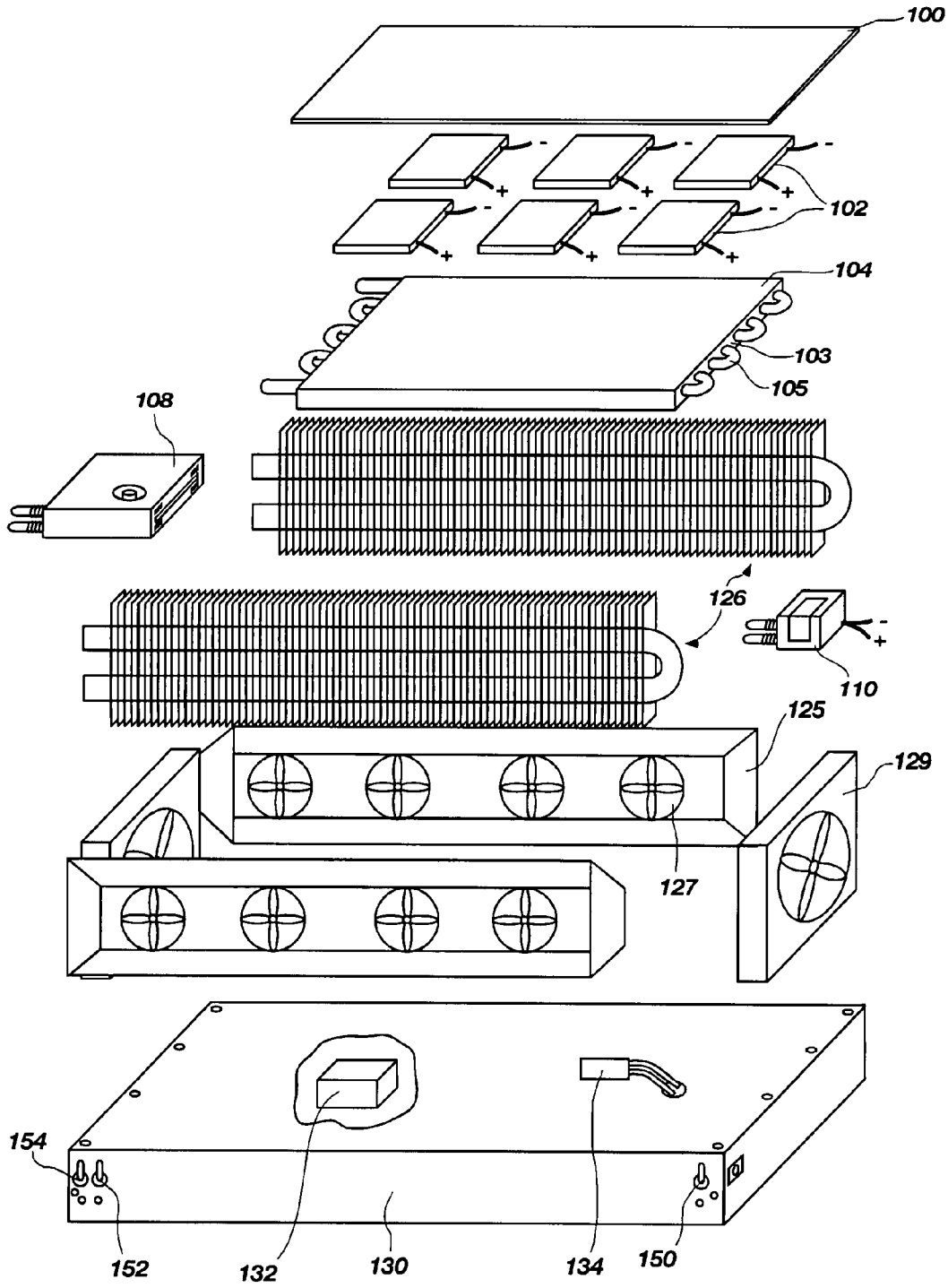

Turning to FIG. 1B a second illustrative embodiment of components for an apparatus 10A in accordance with the principles of present invention, is depicted in an exploded view. For clarity, like elements are consistently numbered between FIGS. 1A and 1B.

A thermally conductive plate 100 forms the upper portion of the apparatus 10A. The thermally conductive plate 100 may be made from a thermally conductive material and must be strong enough to hold a steam tray, chafing dish, or other food container, such as a pan. Suitable thermally conductive materials may include copper, steel, aluminum or other metallic sheets, but it will be appreciated that any thermally conductive material of sufficient strength may be used. As discussed in connection with FIG. 4, conductive plate 100 may form the bottom surface of a steam tray or other container.

Mounted underneath the thermally conductive plate 100 is a plurality of Peltier chips 102. Each Peltier chip 102 is a thermoelectric converter element whose effect is based on the Peltier principle in that they are capable of both cooling and heating by virtue of the fact that between their electrodes a temperature differential is created whose directionality is a function of the direction of the current. In the depicted embodiment, six Peltier chips 102 are shown. It will be appreciated that any number may be used which is sufficient to heat or cool plate 100 to a suitable temperature. Applicants have found that a plurality of Peltier chips is capable of reaching suitable temperatures, contrary to the teachings of the cited prior art references.

Each Peltier chip 102 may be mounted to the plate 100. This could occur using a thermal epoxy or a mounting bracket and thermal grease, as discussed previously herein. The underside of each Peltier chip 102 may similarly be mounted to a heat exchanger 104. Heat exchanger 104 includes a body 103 made of a thermally conductive material through which runs tubing 105. Tubing 105 allows circulation of a heat transfer liquid, such as a coolant, through the heat exchanger 104. For example, where the Peltier chips 102 are running in a cooling mode, and the "hot" side of the chips 102 faces the heat exchanger 104, circulation of coolant through the tubing may be used to remove waste heat from the chips 102.

Tubing 105 exits the heat exchanger 104 and is continuous to one or more radiators 126 positioned below the heat exchanger 104. As depicted, there are two radiators 126, each of which has a generally planar body disposed in a generally vertical orientation, with the long axis parallel to plate 100. In the depicted embodiment, two opposite radiators 126 are spaced apart from each other in a vented stand (as discussed in connection with FIG. 4) and are spaced downwards from the heat exchanger 104 by a gap. One or more fans 127 may be attached to, or placed adjacent to, the radiators 126 to facilitate air movement across the radiators 126 to enhance heat exchange. Fans 127 may be directly attached to the radiator 106 with a suitable thermal epoxy, by attachment using a mounting bracket 125 (as depicted), or in any other suitable manner.

It will be appreciated that although two opposite radiators 126 are depicted that alternative arrangements may be used. For example, a single generally U-shaped, or box shaped radiator that conforms to the shape of the stand 400 may be used, as may multiple smaller radiators.

In the depicted embodiment, there are eight fans 127, with three attached to each radiator 126. It will be appreciated that any suitable number of fans may be used. Further, where two opposite radiators 126 which are spaced apart from each other in a vented stand are used, one or more additional transverse fans 129 may be positioned at an angle to fans 127 to facilitate additional airflow into the vented stand between the opposite radiators 126 and then through the radiators by fans 127. As depicted, where two opposite radiators 126 are used, two transverse fans 129 may be used, one at each end of the space between the fans 127. In other embodiments, a single fan 129 may be used, or the fans 129 may be placed below the radiators 127 to facilitate airflow into the space within the radiators.

As with radiator 106, each radiator 126 is typically finned to provide a larger surface area for convection heat exchange to the surrounding air. The heat transfer fluid may be circulated through the tubing from the heat exchanger 104 to each radiator 126. A non-toxic heat transfer fluid may be used, such as water or the coolant PAHNOL, offered by Houton Chemical.

The tubing 105 may also be communicatively connected with a reservoir 108 and a pump 110. Reservoir 108 provides an opening and cap for filling and draining heat exchange fluid, and pump 110 may be used to circulate the heat transfer fluid through the tubing 105 and radiators 126. In some embodiments, pump 110 and reservoir 108 may be positioned beneath the radiator 106, in order to facilitate access thereto. Pump 110 may be any pump with sufficient power to circulate heat transfer fluid through the tubing 105 at a rate sufficient to allow the device to function at an acceptable rate of heating or cooling. Typically, centrifugal-type pumps may be used, although it may be possible to utilize a larger in-line pump.

Figure 4:
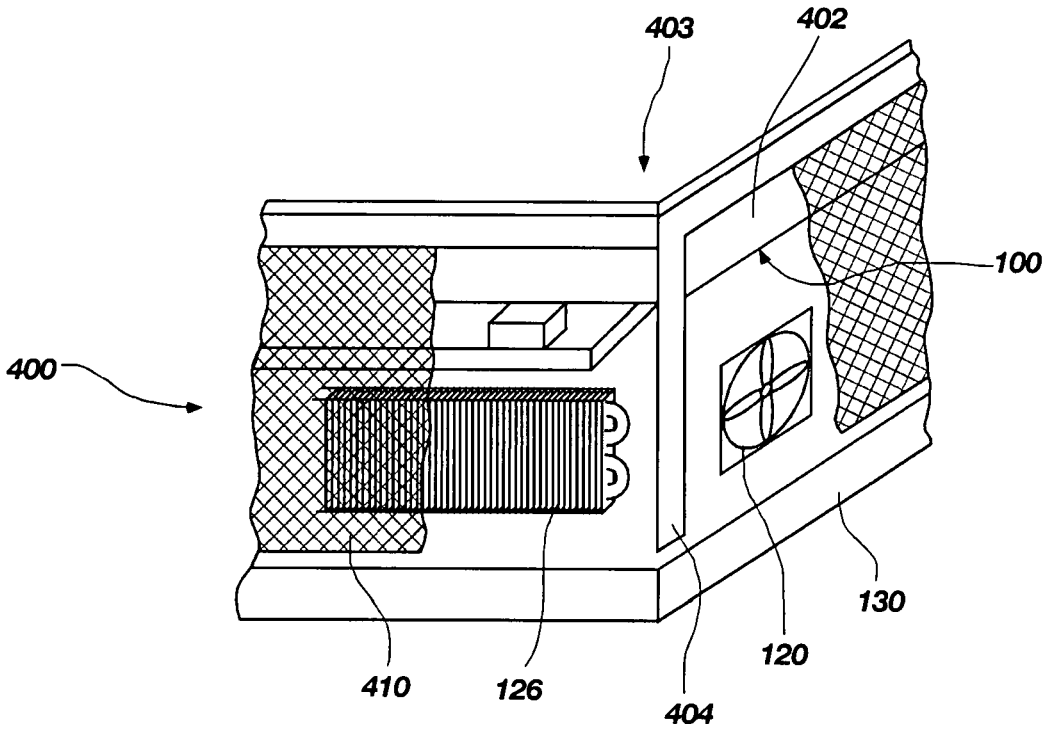
FIG. 4 is a cutaway partial side view showing the relationship of some of the components of FIG. 1B with a frame.

Electric power may be provided by a battery 132, which may also be contained within box 130 that serves as a base for a vented stand 400 (FIG. 4). The battery 132 may be a plurality of wet cell batteries that are linked in a series. Such a battery powered device is extremely portable and may be used in locations where connection to an electrical outlet is undesirable or impossible. Of course, it will be appreciated that a transformer and line connection may be used to provide connection to any standard electrical outlet for power, which may be used to charge the battery 132.

Box 130 may also include the controls for the apparatus 10A. One switch 150 may power the apparatus 10A and additional switches 154 and 152 may control either the operational mode of the Peltier elements, or the functioning of the pump or fans. In other embodiments, variable current controls may be used to adjust the temperature at the thermally conductive plate by varying the current through the Peltier elements. An electrical connection fitting 134 may be used to connect the battery 132 and controls to the remaining elements of the apparatus 10A.

FIG. 4 depicts a portion of a vented stand 400 for use with the components of FIG. 1B. Stand 400 may be placed atop box 130 for use. A pan or tray 402 may be disposed at the top of the stand 400. The thermally conductive plate 100 may form the bottom the tray 402. In use, water may be placed in the tray 402 to serve as a steam tray in a heating mode, and a food containing dish such as a chafing dish tray placed within tray 402 above the water. In a cooling mode, the water may be omitted and the food containing dish may directly contact the thermally conductive plate 100. Typically, stand 400 is sized such that tray 402 is the same size as a standard chafing dish steam tray.

The sides of the stand 400 are vented, at least at the level of the radiators 126. The vented sides may be formed by building stand 400 as a framework of four legs 404 and top and bottom rails, to which a screen material 410 is attached to cover the open space therebetween. Fans 129 may be placed at the screened shorter ends of the stand 400.

In testing, an embodiment similar to that depicted in FIG. 1B has been shown to maintain thermally conductive plate 100 at a temperature of up to 360 degrees F. in a heating mode and to maintain the plate at or below 10 degrees F. in a cooling mode.

While this invention has been described in certain embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

What is claimed is:

1. A system for maintaining a serving dish at a desired temperature for serving food, comprising:

a thermally conductive plate;

at least one Peltier element in thermally conductive contact with the thermally conductive plate;

at least one solid-to-fluid heat exchanger in thermally conductive contact with the at least one Peltier element;

at least one fluid-to-air radiator in fluid communication with the solid-to-fluid heat exchanger, the at least one fluid-to-air radiator comprising a fluid circulating tubing attached to a number of cooling fins; and a fluid reservoir.

2. The system of claim 1, wherein the thermally conductive plate comprises a copper sheet.

3. The system of claim 1, wherein the at least one Peltier element comprises a plurality of Peltier elements.

4. The system of claim 3, wherein the at least one solid-to-fluid heat exchanger comprises a single heat exchanger in thermally conductive contact with the plurality of Peltier elements.

5. The system of claim 1, wherein the at least one fluid-to-air radiator comprises a fluid circulating tubing attached to a number of cooling fins.

6. The system of claim 1, further comprising at least one fan disposed to circulate air across the at least one fluid-to-air radiator.

7. The system of claim 1, further comprising a pump for circulating coolant.

8. The system of claim 1, wherein the thermally conductive plate may be heated or cooled by the at least one Peltier element.

9. A system for maintaining a serving dish at a desired temperature for serving food, comprising:

a thermally conductive plate;

at least one Peltier element in thermally conductive contact with the thermally conductive plate;

at least one solid-to-fluid heat exchanger in thermally conductive contact with the at least one Peltier element by being attached thereto with a thermally conductive epoxy;

at least one fluid-to-air radiator in fluid communication with the solid-to-fluid heat exchanger; and a fluid reservoir.

10. A system for maintaining a serving dish at a desired temperature for serving food, comprising:

a thermally conductive plate;

at least one Peltier element in thermally conductive contact with the thermally conductive plate;

at least one solid-to-fluid heat exchanger in thermally conductive contact with the at least one Peltier element;

at least one fluid-to-air radiator in fluid communication with the solid-to-fluid heat exchanger, the at least one fluid-to-air radiator comprising at least two radiators disposed opposite one another beneath the at least one solid-to-fluid heat exchanger; and a fluid reservoir.

11. A portable apparatus for maintaining food at a desired serving temperature, comprising:

a thermally conductive plate;

a plurality of Peltier elements in thermally conductive contact with the thermally conductive plate; and at least one fluid-to-air radiator in thermally conductive communication with the plurality of Peltier elements, the at least one fluid-to-air radiator comprising a fluid circulating tubing attached to a number of cooling fins;

wherein the thermally conductive plate may be heated by applying a current through the plurality of Peltier elements in a first direction and may be cooled by applying a current through the plurality of Peltier elements in a second direction and removing heat from the plurality of Peltier elements using the at least one fluid-to-air radiator.

12. The apparatus of claim 11, further comprising at least one solid-to-fluid heat exchanger attached to the plurality of Peltier elements and in fluid communication with the at least one fluid-to-air radiator.

13. The apparatus of claim 11, wherein the at least one fluid-to-air radiator comprises at least two radiators disposed opposite one another beneath the at least one solid-to-fluid heat exchanger.

14. The apparatus of claim 11, further comprising at least one fan disposed to circulate air across the at least one fluid-to-air radiator.

15. A portable apparatus for maintaining food at a desired serving temperature, comprising:

a thermally conductive plate;

a plurality of Peltier elements in thermally conductive contact with the thermally conductive plate; and at least one fluid-to-air radiator in thermally conductive communication with the plurality of Peltier elements;

wherein the thermally conductive plate may be heated by applying a current through the plurality of Peltier elements in a first direction and may be cooled by applying a current through the plurality of Peltier elements in a second direction and removing heat from the plurality of Peltier elements using the at least one fluid-to-air radiator.

16. The apparatus of claim 15, further comprising at least one solid-to-fluid heat exchanger attached to the plurality of Peltier elements and in fluid communication with the at least one fluid-to-air radiator.

17. The apparatus of claim 16, wherein the at least one fluid-to-air radiator comprises at least two radiators disposed opposite one another beneath the at least one solid-to-fluid heat exchanger.

18. The apparatus of claim 15, further comprising at least one fan disposed to circulate air across the at least one fluid-to-air radiator.

* * * * *